US009316056B1

(12) United States Patent
Smith

(10) Patent No.: US 9,316,056 B1
(45) Date of Patent: Apr. 19, 2016

(54) DRILLING RIG WITH BIDIRECTIONAL DUAL ECCENTRIC REAMER

(71) Applicant: ALASKAN ENERGY RESOURCES, INC., Anchorage, AK (US)

(72) Inventor: Lee Morgan Smith, Anchorage, AK (US)

(73) Assignee: ALASKAN ENERGY RESOURCES, INC., Anchorage, AK (US)

( * ) Notice: Subject to any disclaimer, the term of this patent is extended or adjusted under 35 U.S.C. 154(b) by 0 days.

(21) Appl. No.: 14/835,645

(22) Filed: Aug. 25, 2015

Related U.S. Application Data

(63) Continuation-in-part of application No. 14/717,969, filed on May 20, 2015, now Pat. No. 9,151,119.

(60) Provisional application No. 62/002,618, filed on May 23, 2014.

(51) Int. Cl.

| | |
|---|---|
| ***E21B 17/22*** | (2006.01) |
| ***E21B 33/06*** | (2006.01) |
| ***E21B 19/084*** | (2006.01) |
| ***E21B 10/26*** | (2006.01) |
| ***E21B 3/04*** | (2006.01) |
| ***E21B 7/28*** | (2006.01) |
| ***E21B 15/00*** | (2006.01) |

(52) U.S. Cl.
CPC . *E21B 10/26* (2013.01); *E21B 3/04* (2013.01); *E21B 7/28* (2013.01); *E21B 15/00* (2013.01); *E21B 33/06* (2013.01)

(58) Field of Classification Search
CPC ..... E21B 7/28; E21B 10/44; E21B 17/22; E21B 19/22; E21B 19/008; E21B 19/02; E21B 19/084; E21B 19/08; E21B 33/06; E21B 33/068
USPC ..... 166/77.2, 78.1, 75.14
See application file for complete search history.

(56) References Cited

U.S. PATENT DOCUMENTS

| | | | | |
|---|---|---|---|---|
| 3,285,678 | A | 11/1966 | Garrett et al. | |
| 3,420,323 | A | 1/1969 | Owens | |
| 3,938,853 | A | 2/1976 | Jurgens et al. | |
| 4,231,437 | A | 11/1980 | Swersky et al. | |
| 4,385,669 | A | 5/1983 | Knutsen | |
| 4,467,879 | A | 8/1984 | Burge | |
| 4,610,307 | A | 9/1986 | Jurgens et al. | |
| 4,610,316 | A | 9/1986 | Boaz | |
| 4,874,045 | A | 10/1989 | Clayton | |
| 5,165,275 | A * | 11/1992 | Donovan | E21B 49/005 250/254 |

(Continued)

FOREIGN PATENT DOCUMENTS

WO 2013167954 A1 11/2013

*Primary Examiner* — Kenneth L Thompson
(74) *Attorney, Agent, or Firm* — Buskop Law Group, PC; Wendy Buskop

(57) ABSTRACT

A drilling rig with bidirectional dual eccentric reamer which forms a larger wellbore than originally drilled and larger than the drill bit diameter. The bidirectional dual eccentric reamer has a shaft with a longitudinal axis supporting a plurality of reamer portions. The reamer portions have a plurality of helical blades of varying thicknesses. The plurality of helical blades can have a plurality of cutting nodes and cutting inserts. The plurality of helical blades have a center of eccentric rotation which is offset from the longitudinal axis, thereby creating an eccentric rotation which allows for the formation of a larger wellbore than originally drilled and larger than the drill bit diameter.

17 Claims, 3 Drawing Sheets

(56) References Cited

U.S. PATENT DOCUMENTS

| | | | | |
|---|---|---|---|---|
| 6,116,356 | A | 9/2000 | Doster et al. | |
| 7,650,952 | B2 | 1/2010 | Evans et al. | |
| 8,162,081 | B2 | 4/2012 | Ballard et al. | |
| 8,336,645 | B2 | 12/2012 | Robson et al. | |
| 8,544,537 | B1 * | 10/2013 | Keast | E21B 19/084 166/75.14 |
| 8,607,900 | B1 | 12/2013 | Smith | |
| 8,752,649 | B2 | 6/2014 | Isenhour | |
| 8,851,205 | B1 | 10/2014 | Short, Jr. et al. | |
| 9,151,119 | B1 * | 10/2015 | Smith | E21B 10/26 |
| 9,163,460 | B2 * | 10/2015 | Isenhour | E21B 10/26 |
| 2005/0211470 | A1 * | 9/2005 | Jeffryes | E21B 10/26 175/27 |
| 2011/0072737 | A1 * | 3/2011 | Wasterval | E21B 7/021 52/115 |
| 2012/0255786 | A1 | 10/2012 | Isenhour | |
| 2013/0180779 | A1 | 7/2013 | Isenhour | |
| 2014/0202770 | A1 | 7/2014 | Zaki et al. | |

* cited by examiner

DRILLING RIG WITH BIDIRECTIONAL DUAL ECCENTRIC REAMER

CROSS REFERENCE TO RELATED APPLICATIONS

The current application is a Continuation in Part and claims priority to and the benefit of co-pending U.S. patent application Ser. No. 14/717,969 filed on May 20, 2015, which claims priority to and the benefit of U.S. Provisional Patent Application Ser. No. 62/002,618 filed on May 23, 2014, both entitled "BIDIRECTIONAL DUAL ECCENTRIC REAMER." These references are hereby incorporated in their entirety.

FIELD

The present embodiments generally relate to a drilling rig with bidirectional dual eccentric devices for increasing the wellbore diameter and improving the quality of the wellbore.

BACKGROUND

A need exists for a drilling rig with an eccentric tool that can smooth and improve quality of a wellbore bidirectionally.

When a dogleg, spiraled path, or tortuous path is cut by a drill bit, the relatively unobstructed passageway following the center of the wellbore can yield a smaller diameter than the wellbore itself. This relatively unobstructed passageway is sometimes referred to as the "drift" and the nominal diameter of the passageway is sometimes referred to as the "drift diameter". The "drift" of a passageway is generally formed by wellbore surfaces forming the inside radii of curves along the path of the wellbore. Passage of pipe or tools through the relatively unobstructed drift of the wellbore is sometimes referred to as "drift" or "drifting".

In general, a need has existed to enlarge a drift diameter without enlarging the diameter of the entire wellbore and to go through a tighter diameter, which can be created when casing is run into a wellbore.

A need exists for a drilling rig that reduces the torque and drag on the drill string and produces closer to a drift wellbore while reaming in two directions.

The present embodiments meet these needs.

BRIEF DESCRIPTION OF THE DRAWINGS

The detailed description will be better understood in conjunction with the accompanying drawings as follows.

Figure 1:
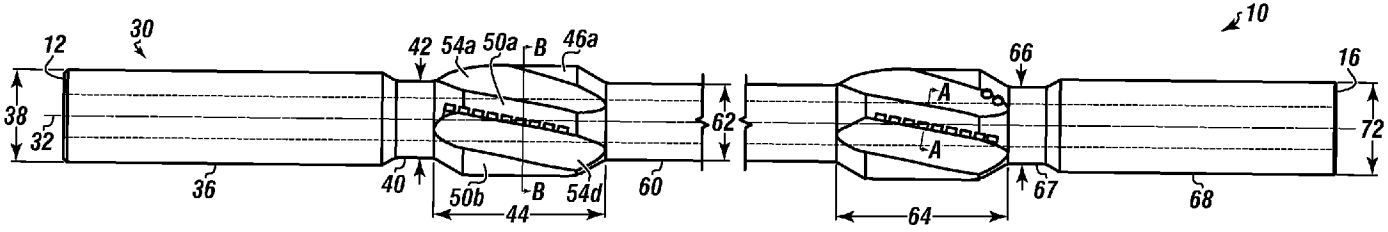
FIG. 1 depicts a side view of a bidirectional dual eccentric reamer of a drilling rig according to one or more embodiments.

The present embodiments are detailed below with reference to the listed Figures.

DETAILED DESCRIPTION OF THE EMBODIMENTS

Before explaining the present device in detail, it is to be understood that the device is not limited to the particular embodiments and that it can be practiced or carried out in various ways.

The drilling rig with bidirectional dual eccentric device improves safety at the well site by reducing the number of trips into a well to solve the problem of drift in the diameter of the wellbore.

The drilling rig with bidirectional dual eccentric device saves the environment by reducing the number of trips, and hence reducing the possibility that wellbore fluid and other material will explode out of a wellbore.

This drilling rig with bidirectional dual eccentric device allows a user to ream a wellbore without jeopardizing the integrity of the casing.

The drilling rig with bidirectional dual eccentric devices uses a bidirectional dual eccentric reamer that can be a 17.5 inch tool or a 3 inch tool.

The term "shaft" as used herein can refer to the integral one piece body of the tool.

The shaft can be cylindrical or it can be a combination of elliptical or concentric shapes. In embodiments, the shaft can have an annulus and an outer diameter from 4 inches to 26 inches. The wall of the shaft can be from ¾ of an inch to 14 inches in thickness. The shaft can be made of steel, coated steel, or another highly durable, high melt weight non-magnetic material. In embodiments, the shaft can be highly impact resistant and resistant to deforming under pressures up to 10,000 psi.

The term "annulus" as used herein can refer to the bore formed longitudinally in the shaft. The annulus can be straight or curved. The annulus can be coated with an additional material to ensure the annulus can be highly corrosion resistant and able to handle high flow rates that other reamers cannot. In embodiments, the shaft can be made from an outer and an inner material, with the inner material being stronger in property and resistance to corrosion than the outer material.

The term "maximum fluid flow" as used herein can refer to the drilling fluid flow rate though the annulus, such as from 100 ppm to 1,500 ppm.

The term "first shaft portion" as used herein can refer to a first portion of the shaft that can have a first diameter that can be an outer diameter that can be from 3 inches to 26 inches. The first shaft portion can have the same shape as the shaft.

The term "second shaft portion" as used herein can refer to a second portion of the shaft that can be integral with the first portion of the shaft and can have a second outer diameter different from the first diameter. The second outer diameter can have a range from 2 inches to 24 inches. The second shaft portion can have the same shape as the shaft.

The term "third shaft portion" as used herein can refer to a third portion of the shaft that can be integral with the second portion of the shaft and can have a third outer diameter different from the first and second diameters of the first and second shaft portions respectively. The third outer diameter can be from 2 inches to 24 inches. The third shaft portion can have the same shape as the shaft. In embodiments, the invention can have from a 1 to 4:1 ratio of length from the first shaft portion to the second shaft portion. In embodiments, the invention can have from a 1 to 4:1 ratio of length from the third shaft portion to the second shaft portion.

The term "first neck" as used herein can refer to a shape created on the shaft that can be integral with the shaft and can provide a first increased flow area for drilling fluid flowing out of the wellbore as the bidirectional dual eccentric reamer reams in and out of the wellbore. The first increased flow area can increase fluid flow from 5 percent to 15 percent.

The term "second neck" as used herein can refer to a shape created on the shaft that can be integral with the shaft and can be configured to provide a second increased flow area for drilling fluid flowing out of the wellbore as the bidirectional dual eccentric reamer reams in and out of the wellbore. The second increase flow area can increase fluid flow from 5 percent to 15 percent. In embodiments, the length of the first neck to the second neck can be 1 to 2:1 or 1:1 to 2 in length. In additional embodiments, the first neck can have a first neck outer diameter and the second neck can have a second neck outer diameter. The second neck diameter can be less than the first neck outer diameter by an amount from 5 percent to 15 percent. Each neck portion can contain the annulus.

The term "reamer portions" as used herein can refer to sections on the outside of the shaft that can be integral with the shaft and are not the necks. The length of the reamer portions can each be from 5 percent to 75 percent of the entire length of the shaft. Each reamer portion can contain the annulus.

The term "first helical blade" as used herein can refer to a piece of metal extending from the shaft along a helical curve having a first thickness. In embodiments, the helical blade can be solid. In embodiments, the first helical blade can be tapered from a thicker portion adjacent the shaft to a thinner portion away from the shaft. In embodiments, the first helical blade can have a scoop shape.

The term "second helical blade" as used herein can refer to a piece of metal extending from the shaft along a helical curve having a second thickness that can be larger than the first thickness of the first helical blade. In embodiments, the second helical blade can be solid. In embodiments, the second helical blade can be tapered from a thicker portion adjacent the shaft to a thinner portion away from the shaft. In embodiments, the second helical blade can have a scoop shape.

The term "flutes" as used herein can refer to indentations or depressions formed between each pair of helical blades. In embodiments, the flutes can be elliptical in shape. In embodiments, the flutes can be tapered on the ends. Each flute can extend up to 50 percent into the wall thickness of the shaft. When tapered, each flute can extend from 5 percent to 50 percent into the wall thickness of the shaft.

The term "cutting nodes" as used herein can refer to polycrystalline diamond compacts installed on at least one edge of at least one helical blade. Since shafts generally rotate clockwise, the cutting nodes can be located on a front side or leading edge of each helical blade that can be the outermost portion of the helical blade and the furthest location away from the shaft. The shape of the cutting node can be circular, triangular, octagonal, square, or any other polygonal shape. The density of the cutting nodes on each helical blade can be from 2 cutting nodes to 30 cutting nodes per inch of helical blade. In embodiments, the diameter of each cutting node can be from ⅛ of an inch to 1 and ½ inch. In embodiments, the cutting nodes can be elevated from a flush fit with the helical blade surface from 1/16 of an inch to ¾ of an inch. In embodiments, the cutting nodes can be mounted onto the helical blade at an angle. The mounting angle can range from 2 degrees to 35 degrees to the plane of the helical blade as the helical blade extends from the shaft.

The term "cutting inserts" as used herein can refer to the tungsten carbide cutting inserts installed adjacent the plurality of cutting nodes on an outermost portion of each helical blade and parallel to the shaft. The shape of the cutting inserts can be circular, trapezoid, octagonal, square, or any other polygonal shape. The density of the cutting insert on each helical blade can be from 2 cutting inserts to 85 cutting inserts per inch of helical blade. In embodiments, the diameter of each cutting insert can be from 1/32 of an inch to ¾ of an inch. In embodiments, the cutting inserts can be elevated from a flush fit with the helical blade surface from 1/32 of an inch to ⅝ of an inch. In embodiments, the cutting inserts can be mounted onto the helical blade at an angle. The mounting angle can range from 0.1 degrees to 35 degrees to the plane of the helical blade as the helical blade extends from the shaft.

The term "center of eccentric rotation" as used herein can refer to a center of rotation that can be offset from the longitudinal axis of the shaft, enabling the bidirectional dual eccentric reamer to form a larger wellbore than a drill bit diameter. The off-center rotation creates an elliptical reaming path that can be larger than the outer diameter for the bidirectional dual eccentric reamer.

In embodiments, the drilling rig with bidirectional dual eccentric devices can use a bidirectional dual eccentric reamer that can be a one piece tool with a shaft with a longitudinal axis and an annulus formed longitudinally within the shaft configured for maximum fluid flow.

In embodiments, the longitudinal axis can be centralized. In embodiments, the annulus can also be centralized.

The bidirectional dual eccentric device can have a first neck with a first neck diameter that is integrally connected to the first shaft portion. The first neck can have an outer diameter from 2 inches to 24 inches. The first neck can have the shape that can be elliptical, concentric, or cylindrical.

In embodiments, the first neck diameter can be at least 10 percent less than the first diameter of the first shaft portion.

In embodiments, the first neck can form an increased flow area external to the bidirectional dual eccentric reamer for drilling fluid flowing out of the wellbore as the bidirectional dual eccentric reamer operates in the wellbore.

The bidirectional dual eccentric device can have a plurality of reamer portions disposed on the shaft and can be integral with the shaft.

Each reamer portion can have a first helical blade extending radially from the shaft.

Each first helical blade can have a first thickness, such as from 0.25 of an inch to 13 inches.

In embodiments, the first helical blade can have a tapered shape with a base thickness adjacent the shaft from 0.25 of an inch to 13 inches and then a middle thickness from 0.5 of an inch to 14 inches and an end thickness on the blade opposite the shaft from 0.25 of an inch to 13 inches.

Each reamer portion can have a second helical blade extending radially from the shaft.

In embodiments, the second helical blade can be identical to the first helical blade.

In embodiments, the second helical blade can have a thickness smaller than the first helical blade from 5 percent to 30 percent.

In embodiments, the second helical blade and the first helical blade can be made of a harder metal than the shaft. For example, the helical blades can be made of 4145 steel and the shaft can be made from 4140 steel. This two metal embodiment allows for two physical features of the reamer simultaneously.

The helical blades can have a coating to increase the hardness of the helical blades. The coating can be a 1 millimeter to 2 millimeter layer of tungsten carbide. In embodiments, the coating can cover the entire helical blade or a portion of the helical blade.

Each reamer portion can comprise additional blades other than the first helical blade and the second helical blade as necessitated by a drilling application.

The shape of these blades can vary in shape and thickness and be any suitable shape as selected for a specific application.

In embodiments, the bidirectional dual eccentric device can have helical blades that are curved.

Each helical blade can have an inclination on each end from 2 degrees to 15 degrees from the shaft and a flattened cutting surface between each inclined end.

For example, in embodiments, the reamer portion can have a third helical blade and a fourth helical blade extending from the shaft. In embodiments, the third helical blade can have the same thickness as the second helical blade and the fourth helical blade can have the same thickness as the first helical blade.

Each reamer portion can have a plurality of flutes formed between helical blades, additional blades, or combinations thereof.

In embodiments, two flutes can be formed between a pair of helical blades.

In embodiments, from 2 flutes to 30 flutes can be formed on any one reamer.

Each reamer portion can have a plurality of cutting nodes installed on at least one edge of each helical blade or additional blade.

In embodiments, the cutting nodes can be polycrystalline diamond compacts or other suitable materials used for drilling wellbores.

Each reamer portion can have a plurality of cutting inserts installed adjacent the cutting nodes.

In embodiments, the cutting inserts can be tungsten carbide inserts, or other suitable materials used for drilling wellbores.

In embodiments, the cutting inserts can be in the shape of circles, rectangles, ellipses, or other suitable shapes as required by a specific application.

The drilling rig with bidirectional dual eccentric reamer can have a second shaft portion with a second diameter in fluid communication with the first shaft portion and the first neck. The annulus formed longitudinally allows fluid flow through the second shaft portion, the first shaft portion, and the first neck as well as each reamer portion of the plurality of reamer portions.

In embodiments, the bidirectional dual eccentric reamer can have a second reamer portion disposed adjacent the second shaft portion in conjunction with a first reamer portion connected to the first shaft portion.

The second reamer portion can be formed from the shaft.

The second reamer portion can extend from the second shaft portion away from the first end of the shaft.

The second reamer portion can be substantially identical to the first reamer portion, or comprise a different structure.

In embodiments, the second reamer portion can have additional blades based upon the needs of a specific application.

The second reamer portion can have a plurality of flutes, wherein each flute can be formed between the helical blades, additional blades, or combinations thereof.

The second reamer portion can have a plurality of cutting nodes installed on at least one edge of each blade.

The second reamer portion can have a plurality of cutting inserts installed adjacent the cutting nodes.

The length ratio of the first reamer portion to the second reamer portion can range from 1:1 to 1:4.

In embodiments, the drilling rig with bidirectional dual eccentric reamer can use a bidirectional dual eccentric reamer with a second neck integrally connected to the second reamer portion. The second neck can have a second neck diameter that can be less than the first diameter, forming a second flow area. In embodiments, the second neck diameter can be at least ten percent less than the first diameter.

The bidirectional dual eccentric reamer of the drilling rig can have a third portion of the shaft. In embodiments, the third portion can have a third diameter, which can be the same diameter as the first diameter.

The bidirectional dual eccentric reamer shaft can have an eccentric rotational axis for the shaft enabling the bidirectional wellbore reaming device to form a larger wellbore than the drill bit diameter and larger diameter wellbore than originally drilled.

In embodiments, the bidirectional dual eccentric reamer can have a center of eccentric rotation which can be offset from a longitudinal axis of the dual eccentric reamer.

In embodiments, the first reamer portion can be rotationally offset from the second reamer portion such that the helical blades of the first reamer portion are offset from the helical blades of the second reamer portion. This arrangement can help to balance the bidirectional dual eccentric reamer during use, as well as allow for drilling larger wellbores.

In embodiments, the bidirectional dual eccentric reamer can have two reamer portions. In other embodiments, it will be obvious to persons having ordinary skill in the art how to build a bidirectional dual eccentric reamer with multiple additional reamer portions.

As an example of use of the drilling rig with the bidirectional dual eccentric reamer, the drilling rig can engage a drill pipe, wherein the drill pipe can be positioned over the wellbore.

With a rotary device, such as a top drive, a power swivel or a rotary table, the drill pipe can be turned into the wellbore. In embodiments, bottom hole equipment is first attached to the drill pipe before it is run into the wellbore.

Once the first drill pipe is installed, a first bidirectional dual eccentric reamer can be connected to one end of the drill sting.

The drilling rig can attach another section of drill pipe to the other end of the bidirectional dual eccentric reamer, sandwiching the bidirectional dual eccentric reamer between two sections of the drill pipe of the drill string.

The bidirectional dual eccentric reamer attached to drill pipe can then be run into the wellbore.

Drilling fluid can be pumped down the annulus of the drill string and the bidirectional dual eccentric reamer simultaneously.

The drilling rig can then rotate the drill string with the bidirectional dual eccentric reamer while drilling fluid is pumped down the annulus of the drill string with the attached bidirectional dual eccentric reamer.

The drilling rig with the bidirectional dual eccentric reamer causes the drill string to rotate about the eccentric axis and enlarge the drilling hole to receive larger completion equipment/liner/casing while simultaneously protecting measurement while drilling equipment or bottom hole assemblies that can be attached to the drill string.

Turning now to the Figures, FIG. 1 depicts a side view of a bidirectional dual eccentric reamer for use with the drilling rig according to one or more embodiments.

The bidirectional dual eccentric reamer 10 can have a shaft 30 with a longitudinal axis 32, a first end 12, and a second end 16. The longitudinal axis can be the axis of rotation of the shaft.

The shaft 30 can have an annulus, not shown in this Figure, for allowing fluid flow along the reamer's longitudinal axis.

The bidirectional dual eccentric reamer 10 can have a first shaft portion 36, connected to a first neck 40. The first shaft portion can have a first diameter 38 that can range from 2 inches to 9 inches in embodiments.

The first neck 40 can be a narrowed portion of the shaft 30. The first neck portion can have a first neck diameter 42 which can be less than the first diameter 38. In embodiments, the first neck diameter 42 can be at least ten percent less than the first diameter. In embodiments, neck 40 can have a neck diameter 42 that ranges from 3.5 inches to 7 inches.

The first neck 40 can have a shoulder at a 30 degree angle reducing the diameter of the shaft for the neck from the first shaft portion 36.

The first neck 40 can be contiguous with the first reamer portion 44. The first reamer portion 44 can be connected to the first neck 40. The first neck can range from 1 inch to 6 inches in length.

A second shaft portion 60 can connect to the first reamer portion 44. The second shaft portion can have a second diameter 62 which can range from 2 inches to 9 inches.

A second reamer portion 64 can be connected to the second shaft portion 60.

The first reamer portion 44 can be contiguous with the second shaft portion 60.

The second shaft portion 60 can be contiguous with the second reamer portion 64. The second reamer portion 64 can be substantially identical to the first reamer portion 44 in structure, or have a different structure, such as comprise two blades when the first reamer portion comprises four blades.

The bidirectional dual eccentric reamer 10 can be shown with a plurality of helical blades 46*a*, 50*a* and 50*ba* with a plurality of flutes 54*a* and 54*d* between the helical blades are flutes.

In embodiments, the second reamer portion 60 can be rotationally offset in relation to the first reamer portion 44 such that the first helical blade 46*a* and the second helical blade 50*a* of the first reamer portion 44 are not aligned with the first helical blade and the second helical blade of the second reamer portion 64 respectively as viewed along the longitudinal axis 32 of the shaft 30.

The second reamer portion 64 can be contiguous with a second neck 67. The second neck 67 can have a second neck diameter 66 which can be less than the first diameter 38. In embodiments, the second neck diameter 66 can be at least ten percent less than the first diameter 38. The second neck diameter 66 need not be the same as the first neck diameter 42.

The second neck 67 can be contiguous with a third shaft portion 68. In embodiments, the third shaft portion 68 can have a third diameter 72, which can be equivalent to the first diameter 38 of the first shaft portion 36.

The second neck 67 can connect to the second reamer portion 64. In embodiments, the second neck can have a second neck diameter 66 equivalent to the first neck diameter.

A third shaft portion 68 can be connected to the second neck 67.

Figure 2:
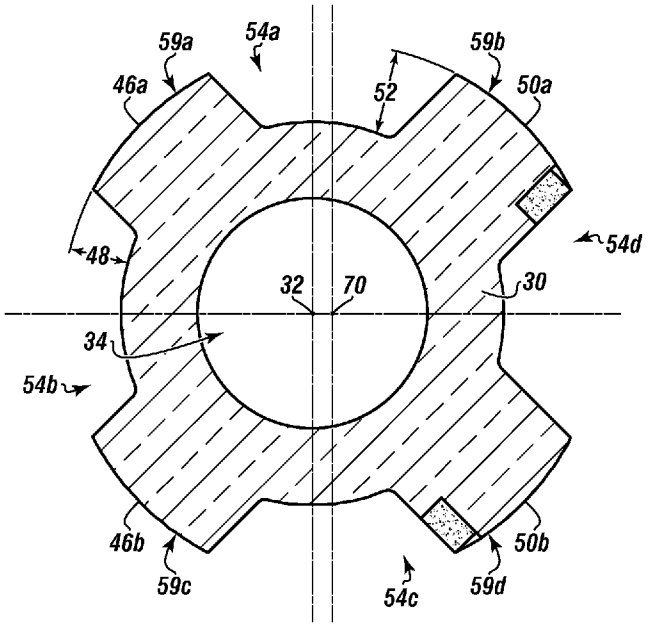
FIG. 2 depicts a cut view of a reamer portion of the bidirectional dual eccentric reamer of a drilling rig according to one or more embodiments.

FIG. 2 depicts a cut view of a reamer portion of the bidirectional dual eccentric reamer for a drilling rig according to one or more embodiments.

The reamer portion is shown with a plurality of helical blades 46*a*, 46*b*, 50*a* and 50*b*.

In embodiments, helical blades 46*a* and 46*b* are shown as the same size and helical blades 50*a* and 50*b* are shown as the same size. In embodiments, the helical blades can have different thicknesses.

The plurality of flutes 54*a*, 54*b*, 54*c*, and 54*d* are shown located between the plurality of helical blades.

The shaft 30 can have an annulus 34 for allowing fluid flow with a center of eccentric rotation 70, which can be proximate to the longitudinal axis 32.

As measured from the outer surface of the shaft, the thickness 52 of the second helical blade 50*a* can be larger than the thickness 48 of the first helical blade 46*a*. In embodiments, the thickness 52 of the second helical blade can be at least thirty percent greater than the thickness 48 of the first helical blade as measured from the outer surface of the shaft.

In embodiments, additional blades 46*b* and 50*b* can be disposed on the shaft.

The outer surfaces 59*a*, 59*b*, 59*c*, and 59*d* of the plurality of helical blades can be viewed as defining a circle at any given cross section of the shaft, and the center of eccentric rotation 70 of that circle as shown.

The center of eccentric rotation 70 can be offset from the longitudinal axis 32 of the shaft, which can also be the axis of rotation of the shaft. This allows the bidirectional dual eccentric reamer to drill a larger bore than the actual bidirectional dual eccentric reamer diameter, as well as a larger diameter wellbore than originally drilled with a drill bit.

Figure 3:
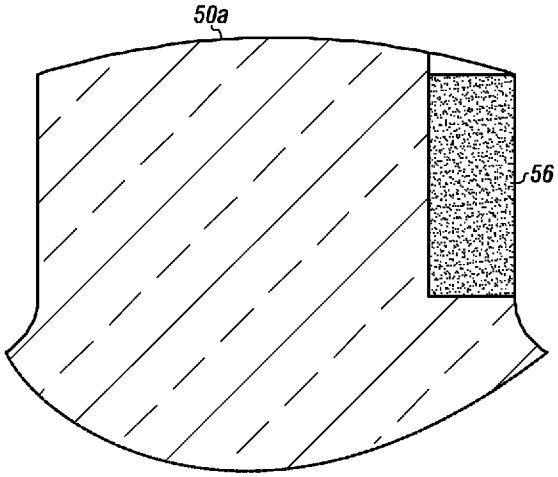
FIG. 3 depicts a detail cut view of a helical blade of the bidirectional dual eccentric reamer of a drilling rig according to one or more embodiments.

FIG. 3 depicts a detail cut view of a helical blade for the bidirectional dual eccentric reamer for a drilling rig according to one or more embodiments.

In this embodiment, a cutting node 56 is shown disposed on the second helical blade 50*a*.

In embodiments, the each blade of the plurality of helical blades can have cutting formed on the blades.

Figure 4:
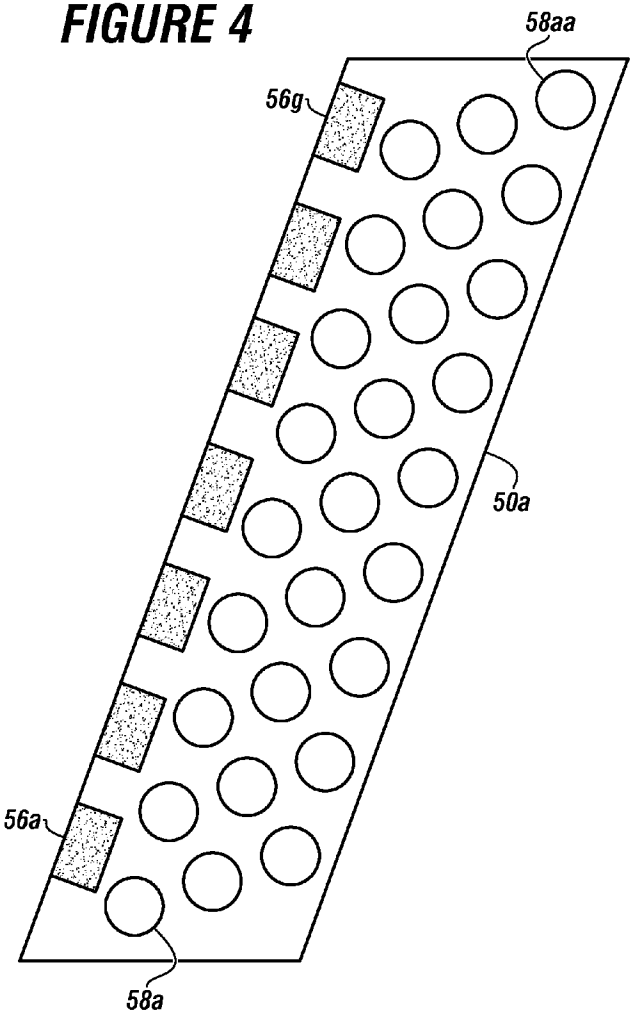
FIG. 4 depicts a detail view of a surface of a helical blade of the bidirectional dual eccentric reamer of a drilling rig according to one or more embodiments.

FIG. 4 depicts a detail view of a surface of a helical blade for the bidirectional dual eccentric reamer for a drilling rig according to one or more embodiments.

In this embodiment, a plurality of cutting nodes 56*a* and 56*g* are shown disposed on the second helical blade 50*a*.

Also attached to the surface of the helical blade 50*a* are a plurality of cutting inserts 58*a* and 58*aa*. While the plurality of cutting inserts 58*a* and 58*aa* are shown as circular in this Figure, alternate embodiments can make use of any suitable shape for the cutting inserts.

In embodiments, the bidirectional dual eccentric reamer can have a first of the plurality of reamer portions disposed on the shaft aligned with a second of the plurality of reamer portions disposed on the shaft, wherein both reamer portions create identical cutting patterns and track each other.

In embodiments, the bidirectional dual eccentric reamer can have a second of the plurality of reamer portions disposed on the shaft rotated to be out of alignment from 0.1 of a degree to 45 degrees with a first of the plurality of reamer portions disposed on the shaft. The out of alignment reamer portions can create different cutting patterns for the same bidirectional dual eccentric reamer.

Figure 5:
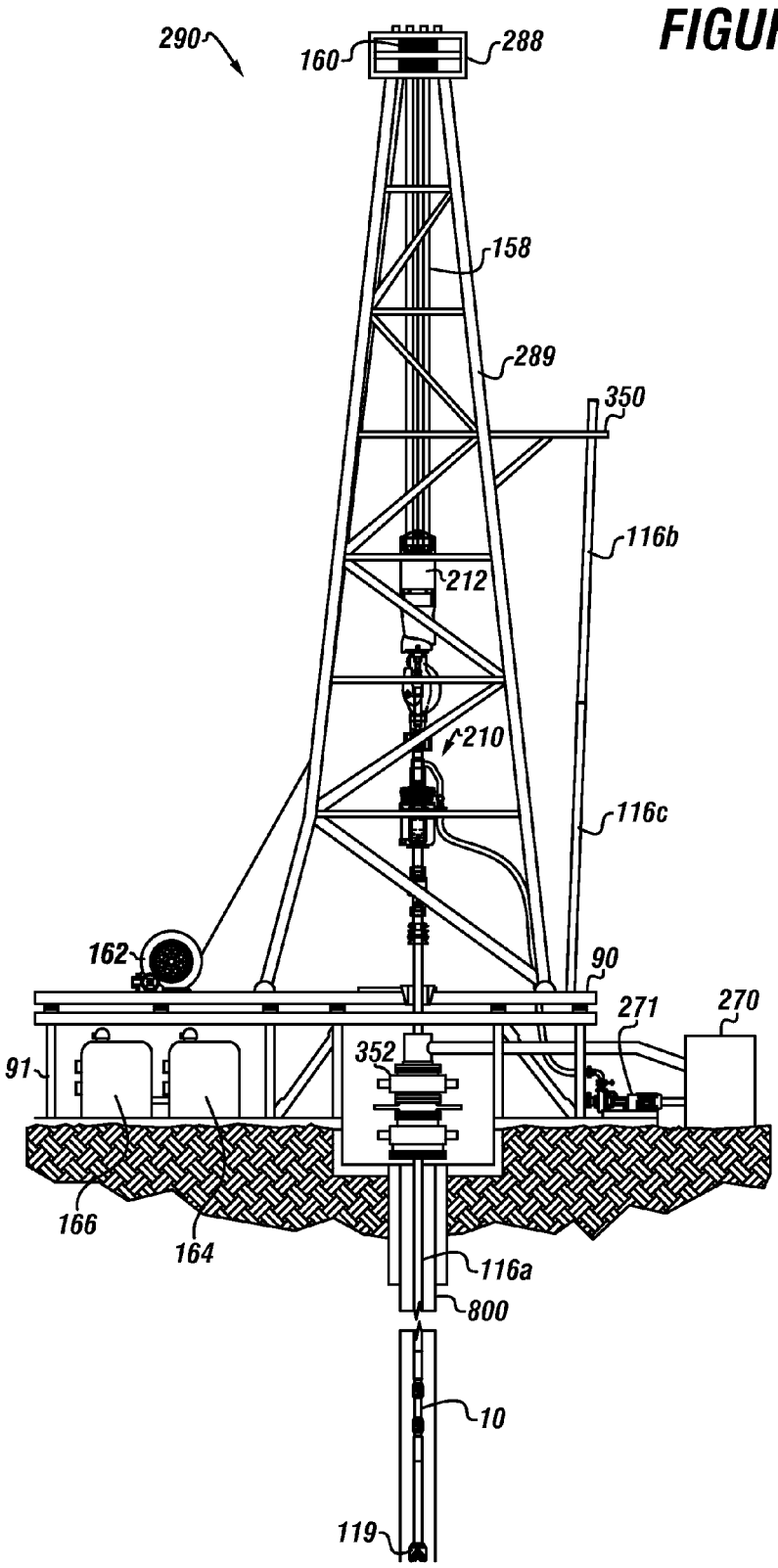
FIG. 5 depicts a drilling rig with bidirectional dual eccentric reamer according to one or more embodiments.

FIG. 5 shows a drilling rig 290 having a bidirectional dual eccentric reamer 10 for reaming into and out of a wellbore 800 according to one or more embodiments.

The drilling rig 290 can have a rig floor 90 and a substructure 91.

The bidirectional dual eccentric reamer is shown coupled on a first end to a drill string and on a second end to a drill bit 119. In embodiments, the drill bit can be a bottom hole assembly or measurement while drilling equipment.

The drilling rig can have a tower 289 having a crown 288 with sheaves 160.

A drawworks 162 can be connected to a drawworks motor 164 connected to a power supply 166.

A cable 158 can be extended from the drawworks through the sheaves over the crown. A lifting block 212 can be connected to the cable.

A hydraulic pump 271 can be connected to a tank 270 for flowing fluid into the wellbore as drill pipe is turned into the wellbore.

A rotating means 210 can be used for turning the drill pipe into the wellbore.

The rotating means can be at least one of: a top drive or a power swivel mounted to the lifting block or a rotary table mounted to a rig floor for rotating drill pipe into a wellbore.

A blowout preventer 352 can be connected between the rotating means and the wellbore for receiving drill pipe.

A bidirectional dual eccentric reamer 10 is mounted in drill pipe sections 116*a* as drill pipe is run into the wellbore with the drilling rig to save the measurement while drilling the equipment and bottom hole components downhole. Additional sections of drill pipe 116*b* and 116*c* can be used downhole, held in a racking position 350.

While these embodiments have been described with emphasis on the embodiments, it should be understood that within the scope of the appended claims, the embodiments might be practiced other than as specifically described herein.

What is claimed is:

1. A drilling rig having a bidirectional dual eccentric reamer for reaming into and out of a wellbore, wherein the bidirectional dual eccentric reamer is coupled on a first end to a drill string and on a second end to a drill bit, the drilling rig comprising:

a. a tower having a crown with sheaves;

b. a drawworks connected to a drawworks motor and connected to a power supply;

c. a cable extending from the drawworks through the sheaves over the crown;

d. a lifting block connected to the cable;

e. a hydraulic pump connected to a tank for flowing fluid into the wellbore as a drill pipe is turned into the wellbore;

f. a rotating means for turning the drill pipe into the wellbore, the rotating means comprising at least one of: a top drive or a power swivel mounted to the lifting block or a rotary table mounted to a rig floor for rotating the drill pipe into the wellbore;

g. a blowout preventer connected between the rotating means and the wellbore for receiving the drill pipe; and h. a bidirectional dual eccentric reamer mounted in drill pipe sections as the drill pipe is run into the wellbore with the drilling rig to save measurement while drilling equipment and bottom hole components downhole, wherein the bidirectional dual eccentric reamer comprises:

(i) a shaft having a longitudinal axis, wherein the shaft comprises:

1. an annulus formed longitudinally in the shaft;

2. a first shaft portion with a first diameter;

3. a first neck having a first neck diameter less than the first diameter;

4. a second shaft portion with a second diameter;

5. a second neck having a second neck diameter, the second neck diameter being less than the first diameter; and 6. a third shaft portion with a third diameter;

(ii) a plurality of reamer portions disposed on the shaft, wherein each reamer portion comprises:

1. a first helical blade extending from the shaft having a first thickness;

2. a second helical blade extending from the shaft having a second thickness that is larger than the first thickness;

3. a plurality of flutes formed between each pair of helical blades; and 4. a plurality of cutting nodes installed on at least one edge of at least one helical blade; and (iii) a center of eccentric rotation which is offset from the longitudinal axis of the shaft, enabling the bidirectional dual eccentric reamer to form a larger wellbore than a drill bit diameter and a larger diameter wellbore than originally drilled by the drill bit.

2. The drilling rig of claim 1, wherein the bidirectional dual eccentric reamer comprising:

a plurality of cutting inserts installed on the first helical blade, the second helical blade or both the first helical blade and the second helical blade.

3. The drilling rig of claim 1, wherein each reamer portion of the plurality of reamer portions comprises at least one additional helical blade.

4. The drilling rig of claim 1, wherein the second helical blade extends at least thirty percent further away from the shaft than the first helical blade.

5. The drilling rig of claim 1, wherein the first neck diameter is at least ten percent less than the first diameter.

6. The drilling rig of claim 1, wherein the second neck diameter is at least ten percent less than the first diameter.

7. The drilling rig of claim 1, wherein the plurality of cutting nodes are installed on at least one edge of at least one helical blade.

8. The drilling rig of claim 1, wherein the plurality of cutting nodes range from 4 cutting nodes to 30 cutting nodes.

9. The drilling rig of claim 2, wherein the plurality of cutting inserts are installed adjacent the plurality of cutting nodes.

10. The drilling rig of claim 2, wherein the plurality of cutting inserts range from 3 cutting inserts to 83 cutting inserts.

11. The drilling rig of claim 1, comprising a length ratio from 1 to 4:1 the first shaft portion to the second shaft portion.

12. The drilling rig of claim 1, comprising a length ratio from 1 to 4:1 the third shaft portion to the second shaft portion.

13. The drilling rig of claim 1, comprising a length ratio of the first neck to the second neck as 1 to 2:1 or 1:1 to 2.

14. The drilling rig of claim 1, comprising the second helical blade with a thickness smaller than the first helical blade from 5 percent to 30 percent.

15. The drilling rig of claim 1, comprising a coating on the helical blades.

16. The drilling rig of claim 1, wherein at least one of the plurality of reamer portions disposed on the shaft is aligned with another of the plurality of reamer portions disposed on the shaft, wherein both reamer portions create identical cutting patterns.

17. The drilling rig of claim 1, wherein a second of the plurality of reamer portions disposed on the shaft is rotated and places the helical blades out of alignment from 0.1 of a degree to 45 degrees from the helical blades of a first of the plurality of reamer portions disposed on the shaft, and wherein both reamer portions create different cutting patterns for the same bidirectional dual eccentric reamer.

* * * * *